United States Patent [19]

Eriksson

[11] Patent Number: 5,048,453

[45] Date of Patent: Sep. 17, 1991

[54] COATING DEVICE

[75] Inventor: Tore Eriksson, Klässbol, Sweden

[73] Assignee: BTG Källe Inventing AB, Säffle, Sweden

[21] Appl. No.: 411,119

[22] Filed: Sep. 22, 1989

[30] Foreign Application Priority Data

Sep. 27, 1988 [SE] Sweden ..... 8803403

[51] Int. Cl.[5] ..... B05C 1/08

[52] U.S. Cl. ..... 118/249; 118/255; 118/258

[58] Field of Search ..... 118/246, 249, 258, 259, 118/230, 319, 261, 262, 221, 255

[56] References Cited

U.S. PATENT DOCUMENTS

| | | | |
|---|---|---|---|
| 2,729,192 | 1/1956 | Warner | 118/262 X |
| 3,387,585 | 6/1968 | Farrell | 118/104 |
| 3,392,702 | 7/1968 | Warner | 118/246 |
| 3,499,786 | 3/1970 | Fry, Jr. | 118/246 X |
| 3,688,736 | 9/1972 | Beck et al. | 118/262 X |
| 4,653,303 | 3/1987 | Richard | 118/259 X |

FOREIGN PATENT DOCUMENTS

| | | |
|---|---|---|
| 3417487 | 11/1985 | Fed. Rep. of Germany . |
| 3735889 | 5/1988 | Fed. Rep. of Germany . |
| 1192515 | 5/1970 | United Kingdom . |
| 2085328A | 4/1982 | United Kingdom . |

*Primary Examiner*—Richard L. Chiesa

*Attorney, Agent, or Firm*—Burns, Doane, Swecker & Mathis

[57] ABSTRACT

A coating device for one-sided or two-sided coating of a travelling web (15), including at least one backing roll (9) and an applicator (2) cooperating therewith to supply size or coating agent to the backing roll (9), and a device (17;19) for smoothing of material supplied to the web (15), and optionally, coating also the other side of the web (15), the coating device including a selfsupporting coating roll (3), the mantel surface of which cooperating with the backing roll (11) is provided with circumferentially extending, mutually parallel grooves or rifles (9) which provide for volumetric or metered application on to the surface of backing roll (9) before its contact with the web (15).

17 Claims, 2 Drawing Sheets

Fig. 5
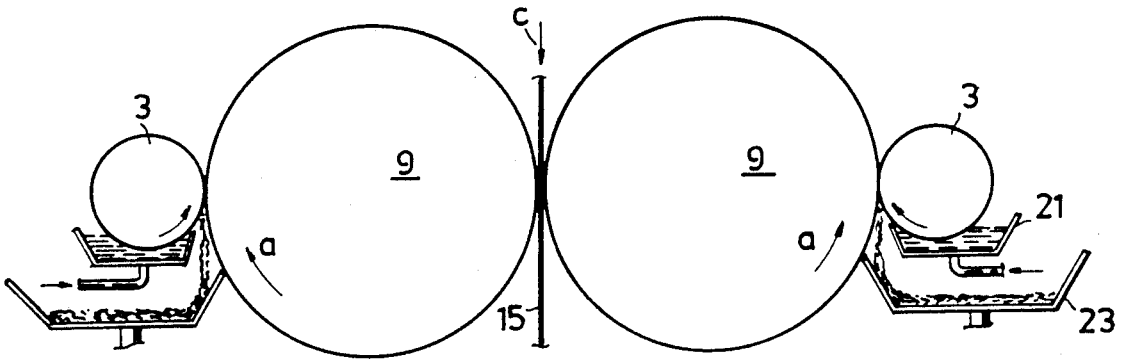
Fig. 6A-D
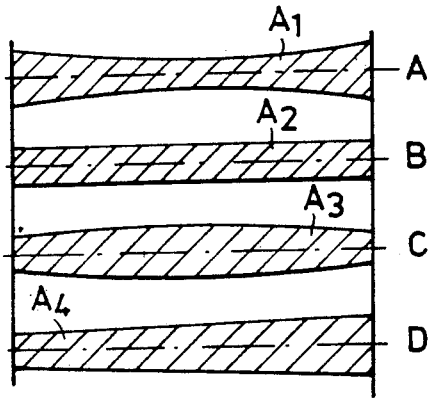
Fig. 7
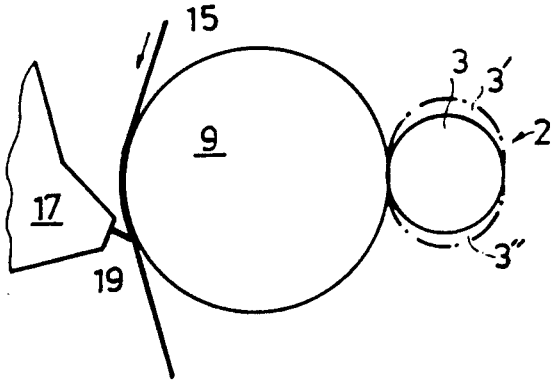

COATING DEVICE

BACKGROUND AND SUMMARY OF THE INVENTION

The present invention relates to a coating device for one-sided or two-sided coating of a travelling web, particularly a paper web. Many devices for sizing or coating of paper webs are known. Many of these are based on transfer of coating material onto the web with the use of metering rolls which either operate immersed in a bath of coating material or are supplied with such material by means of feeding devices extending across the whole width of the web. Such metering rolls that are used in connection with sizers or coating devices of different types are, however, not satisfactory in regard to metering, since they inter alia are strongly viscosity dependent and also result in varying deposition in dependence on web speed. For the purpose of improving metering accuracy so called fast sizers have therefore been developed which are based on metering means consisting of wirewound metering rods which rotate in bearing members extending across the whole width of the web. Such bearing members are necessary since the wirewound metering rods are not selfsupporting. Even if the metering accuracy has been improved by the use of such metering rods this known technique does, however, involve substantial drawbacks among which the following may be mentioned.

The closely wound wire on the metering rod is subjected to a very fast wear in view of the relatively small diameter of the metering rod. The apparatus including its bearing arrangement is, furthermore, mechanically complicated and thereby results in a high investment cost. As will be shown below the first problem of fast wear results in a strongly wear influenced volume of metered material.

The present invention has for its purpose to provide a device by which the prior art drawbacks are eliminated to a great extent and which constitutes a simplified construction and thereby lower costs. Another object of the invention is to provide a coating device resulting in extended life for the metering members thereby offering a more reliable operation.

For these and other objects the present invention provides for a coating device for one-sided or two-sided coating of a travelling web, especially a paper web. This device comprises at least one backing roll and application means cooperating therewith for supplying size or coating agent to the backing roll and, furthermore, means for evening or smoothing of material supplied to the web and, optionally, application means for supplying size or coating agent also to the other side of the web. The coating device is characterized in that the application means comprises self-supporting coating roll, the mantel surface of which cooperating with the backing roll is provided with circumferentially extending, mutually parallel grooves or rifles which provide for volumetric or metered application onto the surface of the backing roll before its contact with the web.

In a preferred embodiment of the coating device according to the invention the coating roll is provided around its mantel surface with a close wire winding, the individual wireturns of which pair-wise form said grooves or rifles. Thus, the wire winding of the coating roll is designed in such a manner that the wire has been wound in one layer with adjacent turns lying in close engagement with each other.

According to an alternative embodiment of the coating device according to the invention the coating roll is around its mantel surface provided with parallel turned or milled grooves. In the same manner as in the wire winding these grooves suitably extend in spiral form around said mantel surface. This spiral-formed arrangement results in simplified machining of the coating roll for providing the desired grooves in its mantel surface.

The diameter of the wire used in the wire winding of the coating roll may vary within wide limits. Normally, it is of the order of millimeters or less, for example some tenths millimeters, such as lying within the range of about 0.2 to about 0.5 mm. The material in the wire is suitably steel or steel alloy.

In the art it is known when using selfsupporting rolls that the contact surface between two rolls, wherein one of the rolls has a somewhat deformable surface, for example of rubber, and the other one has a hard surface, varies along the length of the rolls and is at a minimum at the middle of the rolls. In order to obtain a substantially constant contact surface between the coating roll and the backing roll across the whole width of the web the coating roll may be cambered, i.e. having a diameter decreasing towards the ends thereof and thus the largest diameter in its middle.

An alternative manner of providing for a substantially constant contact surface across the whole width of the web is to subject the coating roll to warping by swinging one end thereof with its other end rotatively and pivotably fixed tangentially along the mantel surface of the backing roll, whereby the contact pressure in the mid section of the rolls increases and the contact surface thereby obtains the desired constant size across the whole width of the web.

It has been indicated above that the coating roll is of a so called selfsupporting type. In order that this criterion shall be met it is suitable that the length-diameter ratio ($L/\phi$) of the coating roll does not exceed about 25. It is preferred that said ratio, which also can be regarded to constitute a so called slimness number, lies within the range of about 10 to about 20. At normal web widths of the order of some meters up to about 6 to 7 meters these slimness numbers mean that the diameter of the roll is of the order of a few decimeters and can be up to about half a meter or more.

The coating device according to the present invention can be designed for two-sided coating of a travelling web and may for this purpose comprise two cooperating backing rolls, between which the web is passed, and two coating rolls, each cooperating with its backing roll, designed in accordance with the invention. According to an alternative embodiment for such two-sided coating the device may also comprise a backing roll with an associated coating roll and a blade coater placed on the opposite side of the backing roll, for example of the BILLBLADE® type.

BRIEF DESCRIPTION OF THE DRAWINGS

The invention will in the following be further illustrated by non-limiting examples of embodiments of the coating device according to the invention. This illustration is made in connection with the appended drawings, wherein:

FIG. 5 shows an alternative embodiment of the device according to the present invention for two-sided coating;

FIG. 6A shows a first contact surface between a backing roll and a coating roll;

FIG. 6B shows a second contact surface between a backing roll and a coating roll;

FIG. 6C shows a third contact surface between a backing roll and a coating roll;

FIG. 6D shows a fourth contact surface between a backing roll and a coating roll;

FIG. 7 illustrates the technique of using warped coating roll.

DETAILED DESCRIPTION OF THE PREFERRED EMBODIMENTS

Figure 1A:
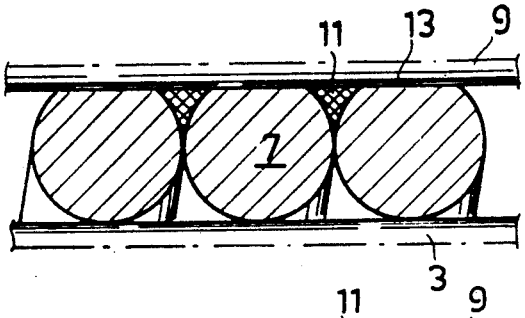
FIGS. 1A and 1B illustrate the problem in connection with the wirewound metering rod according to the conventional technique.
Figure 1B:
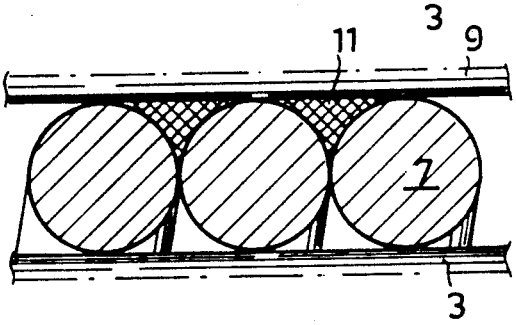

In FIG. 1A and FIG. 1B the prior art problems are illustrated in connection with rapid wear of the wire turns in the wirewound metering rod according to known techniques. In FIG 1B there is shown in an enlargement a detail of three wires 7 in cross section wound around a metering rod 3 and engaging a backing roll 9. As is clear from FIG. 1B the adjacent wire turns define a precise cross section 11 resulting in constant metering of coating material on the backing roll 9.

In FIG. 1A there is shown a corresponding arrangement after certain wear 13 of the outer surface of the wires 7. The figure illustrates how strongly this wear in turn affects the cross section 11 and thus the metering.

It may be added that the diameter of the known wirewound metering rods is of the order of 10 to 15 mm, which on the other hand means that the metering rod must be supported along its whole length and on the other hand a rapid wear arises in view of the small circumference of the rod.

Figure 4:
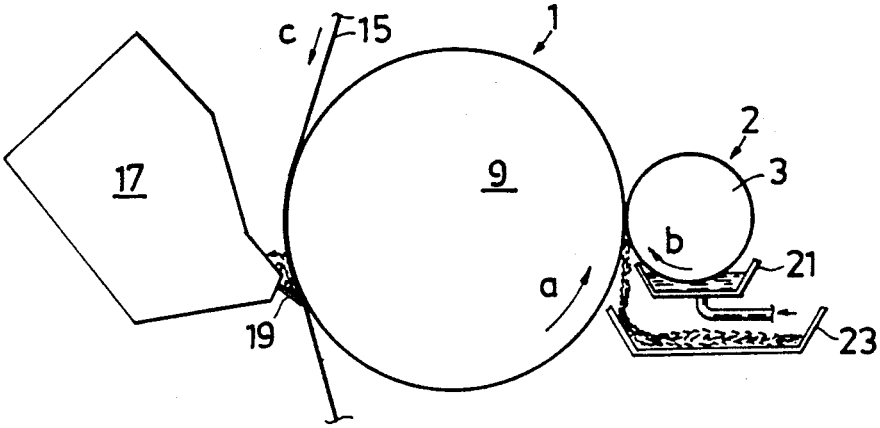
FIG. 4 shows diagramtically a coating device according to the present invention.

In FIG. 4 there is shown diagramtically a coating device according to the present invention generally designated 1. The device comprises a backing roll 9 which is rotated in direction of arrow a, a conventional blade coater 17 having a blade 19 and coating means generally designated 2. The paper web 15 which by means of the device of FIG. 4 is coated on both sides with for example coating composition travels in the direction of arrow c.

The coating device 2 comprises a coating roll 3 of a selfsupporting type which is rotated in the direction of arrow b and which is supported at the ends thereof in a manner not shown in the figure. This support by the use of bearings is of a conventional nature. The coating roll 3 extends at its lower part across its whole length down into a bath of coating composition or liquid which is supplied to a supply shoot 21 and thus transfers coating composition onto the mantel surface of the backing roll 9 for further transportation up to the side of paper web 15 facing roll 9. Excess of coating composition is drained at the nip and collected in a collecting shute 23 for recirculation into the process.

On the opposite side of the backing roll 9 a conventional blade coater 17 is arranged which supplies coating composition or liquid at the nip before the blade 19 on the opposite side of paper web 15. In the nip between blade 19 and backing roll 9 also evening of applied material takes place.

Figure 2:
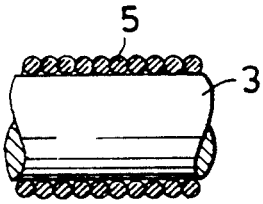
FIG. 2 shows a section of a selfsupporting metering roll according to the present invention.

The coating roll 3 is in the embodiment shown provided with a wire winding 5, as shown in FIG. 2. In the example shown the wire of wire winding 5 has a diameter of the order of 0.3 mm, whereas the coating roll 3 has a diameter of the order of 3 dm.

Figure 3:
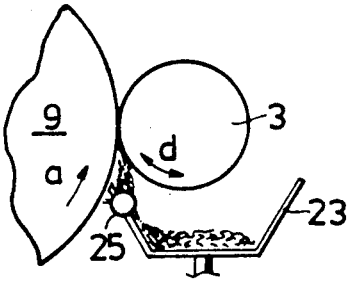
FIG. 3 shows a detail of an embodiment of the device according to the invention.

In FIG. 3 there is shown diagramatically a detail of an alternative embodiment of the device according to FIG. 4. In this embodiment the coating roll 3 is rotated in either direction and the coating composition or liquid is in this embodiment supplied through an ejection tube 25 in which through nozzles distributed along the whole length of the ejection tube and the whole width of the web supply coating composition or liquid to the backing roll 9 and the liquid is transported up to the nip between coating roll 3 and backing roll 9. In other respects the device operates in the same manner as that shown in FIG. 4.

In FIG. 5 there is shown an alternative embodiment of the device according to the invention intended for two-sided coating of paper web 15 which travels downwardly in the direction of arrow c. This device comprises two backing rolls 9 rotating in direction of arrow a and between which in the nip the paper web 15 is fed downwardly. Each backing roll has an associated coating device with a coating roll 3 as described early in connection with FIG. 4. By this arrangement the paper web 15 is supplied at both sides thereof with coating composition or size with accurate metering of the quantity supplied.

The arrangement shown in FIG. 5 can be modified by relocation of rolls 9 and associated coating rolls 3. If as seen in FIG. 5 and without changing the direction of rotation of the two rolls 9 the left roll 9 and its associated application means are placed on top of the right roll 9, then the paper web 15 can enter the upper extreme of top roll 9 from the left in a horizontal plane and then pass around the right side of roll 9 and down into the nip between the two rolls 9 and proceed around the left side of the lower roll 9 and leave said roll at the bottom thereof traveling to the right in a horizontal plane. By this modified arrangement paper web 15 will be coated on both sides although subsequently and not simultaneously as with the embodiment shown in FIG. 5.

In FIGS. 6A–D there are illustrated different designs of the contact surface arising between coating roll 3 and backing roll 9.

FIG. A shows the shape of the contact surface with a coating roll which has not been compensated with regard to the contact pressure in the nip between coating roll 3 and backing roll 9. As is clear from FIG. 6A the contact surface $A_1$ has a minimum width at the mid section of the rolls because of the deflection of coating roll 3, whereas the width of the contact surface $A_1$ is at a maximum at the ends. FIG. 6B shows a contact surface $A_2$ which is substantially constant over the whole length of the rolls. This can be obtained either by warping the coating roll 3 or by cambering same, i.e. designing the roll with a larger diameter in the middle section thereof than at the end sections thereof.

In FIG. 6C there is shown a contact surface $A_3$ having a maximum at the mid section of the rolls. This may result either from too high a cambering of roll 3 or by too large of a warpage thereof along the mantel surfaces of the backing roll 9.

Finally, FIG. 6D shows a contact surface $A_4$, the width of which increases from the left to the right. This can be obtained by a combination of difference in pressure between the ends of the rolls and by cambering or warping.

In FIG. 7 there is shown an alternative embodiment of the coating device according to the present invention. This device comprises, as in FIG. 4, a backing roll 9, a coating means 2 on its right side and a blade coater 17 on its left side. In other respects the device operates in the same manner as that described in connection with FIG. 4.

The coating device 2 with the coating roll 3 is, in the embodiment shown in FIG. 7, provided with a warped roll 3. This means that one end of the coating roll 3 is rotatively and pivotably fixed, whereas its other end has been rotated upwardly or downwardly along a circular arc, having a centre conincident with the centre of backing roll 9, to position 3' or 3", respectively. By this warpage across a proper part of the mantel surface of backing roll 9 a constant contact pressure will be obtained in the nip between the two rolls 3,9 thereby resulting in a contact surface which is substantially contact along the whole length of the rolls. This corresponds to FIG. 6B with contact surface $A_2$ as previously described.

As previously indicated, instead of warping the coating roll 3 cambering can be used, i.e. the coating roll 3 is manufactured having a diameter decreasing towards its ends. This is an alternative way of obtaining a substantially constant width of the contact surface corresponding to FIG. 6B.

The present invention is in no way limited to the embodiments described above. It can also be used in each instance where it is desirable to apply to travelling webs on one or both sides thereof some material, for example coating liquid or composition, size or other desired material for modifying the properties or appearance of the paper. In all embodiments described the wire winding 5 can be replaced by turned or milled grooves which can extend in parallel around coating roll 3 perpendicularly to a conceived centre line though same or can extent in spiral form in a corresponding manner as the wires of the wire winding 5. Such turned or milled grooves can be designed with varying cross sections, all from square or rectangular cross sections to rounded cross sections. The dimensions of these cross sections correspond largely to the dimension of the individual wires 7 in the wire winding 5.

I claim:

1. A coating device for coating a travelling web, comprising at least one backing roll for contacting the web, application means cooperating therewith to supply a coating material to said backing roll, and means for smoothing material supplied to the web, said application means including a self-supporting coating roll, a mantel surface of said coating roll being provided with circumferentially extending, parallel grooves, said mantel surface cooperating with said backing roll to apply said coating material to a surface of said backing roll with metered application before said backing roll contacts the web, said self-supporting coating roll having a length-to-diameter ratio of less than about 25.

2. A coating device according to claim 1 wherein said coating roll is cambered to form a contact surface between said coating roll and said backing roll which is contant across the whole width of said rolls.

3. A coating device according to claim 1, wherein one end of said coating roll is pivotably and rotatively fixed while the other end of said coating roll is swung tangentially along an outer surface of said backing roll, such that said coating roll is warped to provide a contact surface between said coating roll and said backing roll which is substantially constant across the whole width of said rolls.

4. A coating device according to claim 1, wherein said ratio lies within a range of about 10 to about 20.

5. A coating device according to claim 1, wherein said coating device comprises two cooperating backing rolls between which the web is conveyed, and two coating rolls cooperating with said backing rolls, respectively.

6. A coating device according to claim 1, wherein said backing roll and said coating roll are located on one side of the web, and wherein a blade coater is placed on an opposite side of the web.

7. A coating device according to claim 1, wherein said coating roll includes a close wire winding around said mantel surface, pairs of individual wireturns of said wire winding forming said grooves.

8. A coating device according to claim 7 wherein said coating roll is cambered to form a contact surface between said coating roll and said backing roll which is constant across the whole width of said rolls.

9. A coating device according to claim 7, wherein one end of said coating roll is pivotably and rotatively fixed while the other end of said coating roll is swung tangentially along an outer surface of said backing roll, such that said coating roll is warped to provide a contact surface between said coating roll and said backing roll which is substantially contact across the whole width of said rolls.

10. A coating device according to claim 7, wherein said coating device comprises two cooperating backing rolls between which the web is conveyed, and two coating rolls cooperating with said backing rolls, respectively.

11. A coating device according to claim 7, wherein said backing roll and said coating roll are located on one side of the web, and wherein a blade coater is placed on an opposite side of the web.

12. A coating device according to claim 1, wherein said grooves are parallel grooves milled in said mantel surface.

13. A coating device according to claim 12 wherein said coating roll is cambered to form a contact surface between said coating roll and said backing roll which is constant across the whole width of said rolls.

14. A coating device according to claim 12, wherein one end of said coating roll is pivotably and rotatively fixed while the other end of said coating roll is swung tangentially along an outer surface of said backing roll, such that said coating roll is warped to provide a contact surface between said coating roll and said backing roll which is substantially constant across the whole width of said rolls.

15. A coating device according to claim 1, wherein said grooves extend in the form of a spiral around said mantel surface.

16. A coating device according to claim 15 wherein said coating roll is cambered to form a contact surface between said coating roll and said backing roll which is constant across the whole width of said rolls.

17. A coating device according to claim 15, wherein one end of said coating roll is pivotably and rotatively fixed while the other end of said coating roll is swung tangentially along an outer surface of said backing roll, such that said coating roll is warped to provide a contact surface between said coating roll and said backing roll which is substantially constant across the whole width of said rolls.

* * * * *